US006866123B2

(12) United States Patent
Kim

(10) Patent No.: US 6,866,123 B2
(45) Date of Patent: Mar. 15, 2005

(54) OIL SUPPLY APPARATUS FOR HERMETIC COMPRESSOR

(75) Inventor: Jong-Hyuk Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/144,789

(22) Filed: May 15, 2002

(65) Prior Publication Data

US 2002/0170778 A1 Nov. 21, 2002

(30) Foreign Application Priority Data

May 18, 2001 (KR) ..... 2001-27389

(51) Int. Cl.[7] ..... F01M 1/00; F04B 17/00
(52) U.S. Cl. ..... 184/6.16; 417/410.3
(58) Field of Search ..... 184/6.16, 31, 54, 184/61; 415/88; 417/410.3, 372, 423.13

(56) References Cited

U.S. PATENT DOCUMENTS 3,790,309 A * 2/1974 Volz ..... 417/368
3,790,311 A * 2/1974 Butts et al. ..... 417/410.3
4,488,855 A * 12/1984 Butterworth et al. ..... 417/368
5,007,808 A * 4/1991 Fraser et al. ..... 417/368
6,450,785 B1 * 9/2002 Dellby et al. ..... 417/410.3

FOREIGN PATENT DOCUMENTS

CN 1079028 12/1993

* cited by examiner

*Primary Examiner*—David Fenstermacher
(74) *Attorney, Agent, or Firm*—Fleshner & Kim, LLP

(57) ABSTRACT

An oil supply apparatus for a hermetic compressor includes: a crankshaft coupled with a motor so as to revolve together and having an oil flow path inside, a sleeve connected to a lower part of the crankshaft so as to revolve together with the crankshaft in one body, a sucking member arranged to maintain a uniform interval with an inner circumference face of the sleeve so as to carry out a suction of an oil, and a support means for supporting the sucking member to slide, the support means connected between the sleeve and sucking member so as to maintain a stationary state. The sucking member is supported so as not to revolve at the revolving center of the sleeve, thereby maintaining a uniform gap between the inner circumference face of the sleeve and the sucking member regardless of the vibration from the actuating compressor so as to improve oil supply reliance.

26 Claims, 5 Drawing Sheets

OIL SUPPLY APPARATUS FOR HERMETIC COMPRESSOR

BACKGROUND OF THE INVENTION

1. Field of the Invention

The present invention relates to an oil supply apparatus for a hermetic compressor, and more particularly, to an oil supply apparatus for a hermetic compressor that is capable of increasing oil supply quantity and increasing a lubricating performance of oil.

2. Description of the Background Art

Generally, a hermetic compressor is as an apparatus for compressing and supplying a fluid and is mainly applied to a cooling system such as a refrigerator, an air conditioner, or the like.

FIG. 1 illustrates a cross-sectional view of a hermetic compressor according to a related art.

Referring to FIG. 1, a hermetic compressor according to a related art includes a hermetic casing 1 providing a hermetic space inside, a motor 3 installed inside the hermetic casing 1 so as to provide a driving power, a compression unit 30 which carries out a compression of a fluid by the driving power of the motor 3, and a oil supply apparatus 20 for supplying an inside of the hermetic casing 1 with an oil so as to perform lubrication and cooling.

The motor 3 includes a stator 4 wound with a magnetization coil and a rotor 5 made of a permanent magnet, thereby generating a turning force by an electromagnetic reciprocal reaction between the stator 4 and rotor 5.

The compression unit 30 includes a crankshaft 7 connected to the motor 3 to rotate and having an eccentric part at an upper part, a connecting rod 8 for transferring a turning force generated from a rotation of the crankshaft 7, a piston 9 connected to the connecting rod 8 to reciprocate so as to carry out a compression of a fluid, a cylinder 6 having the piston 9 reciprocate inside and providing a compression room for compressing the fluid, and a valve assembly 10 arranged at a front side of the cylinder 6 so as to open/close the compressed fluid.

The oil supply apparatus 20 includes an oil flow path 12 formed inside the crankshaft 7 in a lengthwise direction so as to supply sliding and frictional parts inside the compressor with the oil, a sleeve 11 coupled with a lower part of the crankshaft 7 so as to rotate together with the crankshaft 7, a sucking member 13 arranged so as to maintain a predetermined gap with an inner circumferential face of the sleeve 11 and sucking the oil through the gap when the sleeve 11 rotates so as to supply the oil flow path 12 with the sucked oil, and a support bracket 14 supporting the sucking member 13 while it is inserted in the inner circumference face of the sleeve 11.

The sucking member 13, a lower part of which is supported by the support bracket 14, is arranged so as to maintain a predetermined gap with an outer circumferential face of the sleeve 11, as well as to remain relatively stationary inside the sleeve 11 which rotates together with the crankshaft 7. A spiral oil flow path is formed at an outer circumferential face of the sucking member 13 so as to suck the oil along the spiral oil flow path when the sleeve 11 rotates.

The bracket 14 has a predetermined elasticity. A central part of the bracket 14 is fixed to the lower part of the sucking member 13 so as to support the sucking member 13 so that it does not rotate with the sleeve 11. Both extending parts of the bracket 14 from the central part are fixed to the lower part of the stator 4.

Operation of the above-constructed oil supply apparatus for the hermetic compressor is explained as follows.

First, once the motor 3 rotates, the crankshaft 7 rotates to transfer a dynamic power to the compression unit 30 so as to compress the fluid.

When the crankshaft 7 rotates by the rotation of the motor 3, the sleeve 11 rotates while the sucking member 13 supported by the bracket 14 remains stationary inside the sleeve 11. Hence, the oil is sucked in along the spiral oil flow path at the outer circumferential face of the sucking member 13 by the relative rotation of the sleeve 11 for the sucking member 13.

The oil having sucked in through the sucking member 13 is carried to an upper part through the oil flow path 12 of the crankshaft 7 to sliding and exothermic parts of the hermetic casing 1 so as to carry Out lubrication and heat dissipation.

As discussed above, the sucking member 13 is fixed to the bracket in the above-constructed hermetic compressor according to the related art, the sleeve 11 rotates together with the crankshaft 7. When a vibration occurs in driving the compressor, the sucking member 13 is fixed but the sleeve 11 shakes due to the vibration of the compressor. Hence, it is difficult to maintain a precise gap between the outer circumferential face of the sucking member 13 and the inner face of the sleeve 11, whereby the suction power of the oil is reduced. Thus, the frictional and sliding parts in the compressor fail to be supplied with the oil sufficiently. Hence, abrasion and damage are caused on the frictional and sliding parts so as to degrade performance of the hermetic compressor.

Moreover, in the assembly process, the bracket 14 supports the lower part of the sucking member 13 having been inserted in the sleeve 11, and then both ends of the support bracket 14 are fixed to the stator 5. Therefore, the assembly process becomes more complicated.

SUMMARY OF THE INVENTION

Accordingly, the present invention is directed to an oil supply apparatus for a hermetic compressor that substantially obviates one or more problems due to limitations and disadvantages of the related art.

An object of the present invention is to provide an oil supply apparatus for a hermetic compressor enabling to increase an oil supply performance by maintaining a uniform gap between a sucking member and a sleeve in a manner that amplitudes of the sucking member and sleeve are kept equal to each other by having the sucking member of the compressor supported by the sleeve when the hermetic compressor generates vibration.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an oil supply apparatus for a hermetic compressor according to the present invention includes a crankshaft coupled with a motor so as to revolve together and having an oil flow path inside, a sleeve connected to a lower part of the crankshaft so as to revolve together with the crankshaft in one body, a sucking member arranged to maintain a uniform interval with an inner circumference face of the sleeve so as to carry out a suction of an oil, and a support means for supporting the sucking member to slide, the support means connected between the sleeve and sucking member so as to maintain a stationary state.

Preferably, the oil supply apparatus further includes an anti-rotating member installed at a lower part of the sucking member so as to prevent the sucking member from rotating by generating a resistance force by a viscosity of the oil.

Preferably, the sleeve is cylindrical so that an upper outer circumference face of the sleeve is pushed to be fixed to a lower side of the crankshaft.

Preferably, the sucking member is arranged inside the sleeve so as to leave a uniform interval from each other, a spiral oil flow path is formed at an outer circumference face of the sucking member so as to carry out the suction of the oil, and a penetrating hole is formed in the sucking member in a length direction.

Preferably, the support means includes a hanging member connected to both upper sides of the sleeve in a radial direction, a connecting member connected to a center of the hanging member downward vertically, and a sliding portion between the connecting and sucking members so as support the sucking member to slide.

More preferably, the sliding portion includes a hinge ball built in one body with an end of the connecting means and a spherical recess at a penetrating hole of the sucking member so as to enable the hinge ball to fit in to slide.

More preferably, the hanging member is a bar type having a predetermined length and both ends of the hanging member are fixed to fixing recesses penetrating across an upper end of the sleeve.

More preferably, the anti-rotating member includes a cylindrical fixed part inserted in a penetrating hole of the sucking member so as to be fixed and a plurality of blades at the fixed part in an inner circumferential direction of the fixed part so as to generate a resistance against a viscosity of the oil filling a lower side of a body of the oil supply apparatus.

More preferably, both ends of the hanging member fit in fixing recesses at both upper sides of the sleeve and a middle portion of the hanging member is bent so as to maintain a connecting position of the connecting member precisely.

More preferably, the hanging member extends from a middle portion to both ends obliquely and is formed of an elastic material having a predetermined elasticity exerting in a stretching-out direction of both of the ends of the hanging member.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
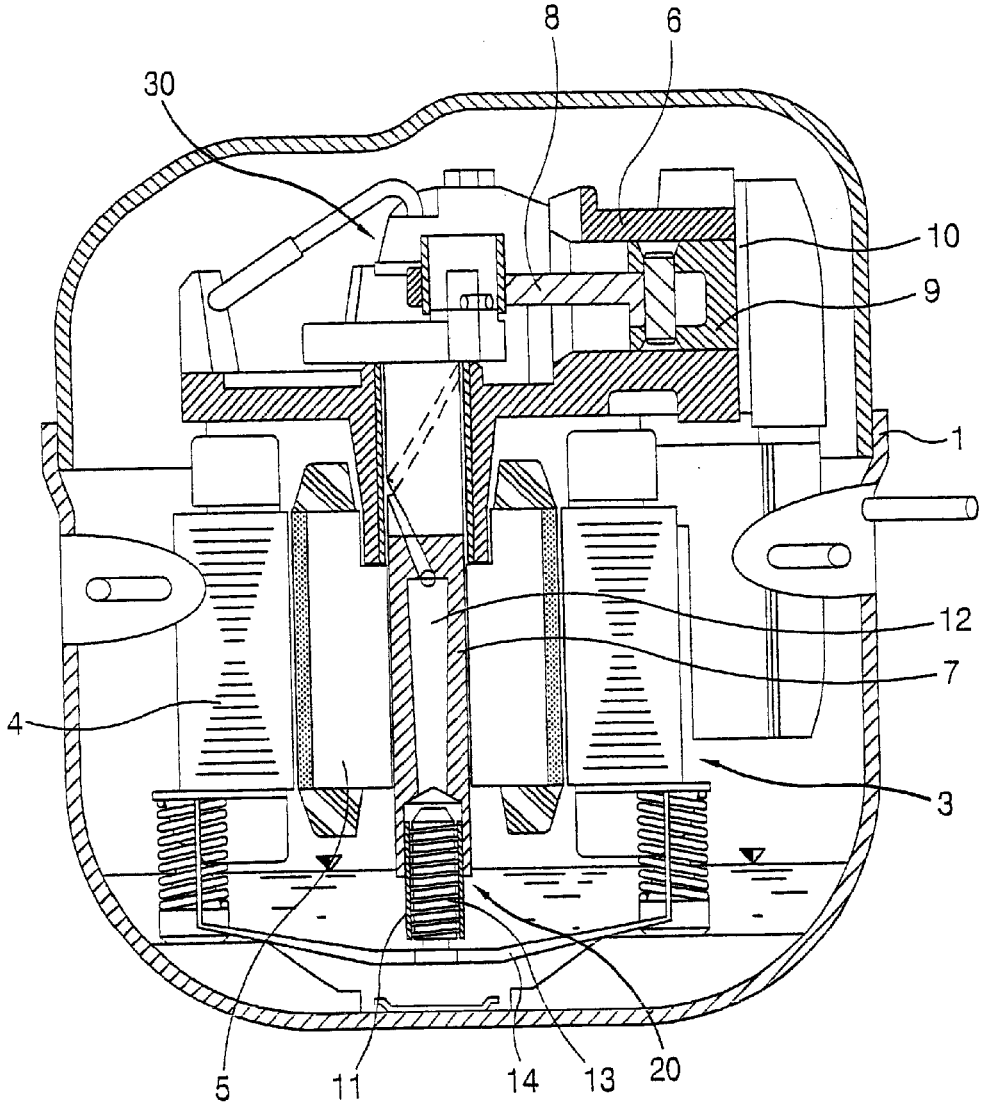
FIG. 1 RELATED ART
FIG. 1 illustrates a cross-sectional view of a hermetic compressor according to a related art.
Figure 2:
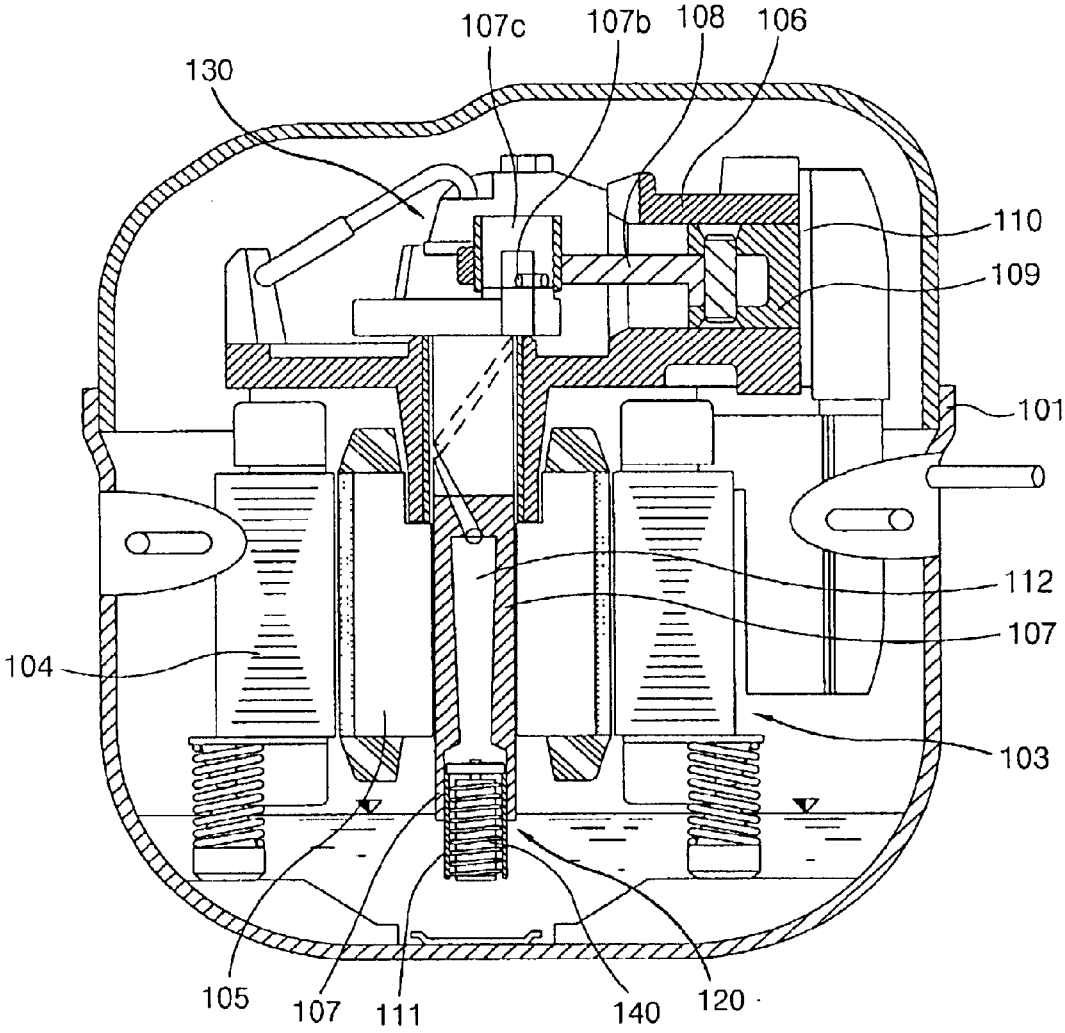
FIG. 2 illustrates a cross-sectional view of a hermetic compressor according to an embodiment of the present invention.
Figure 3:
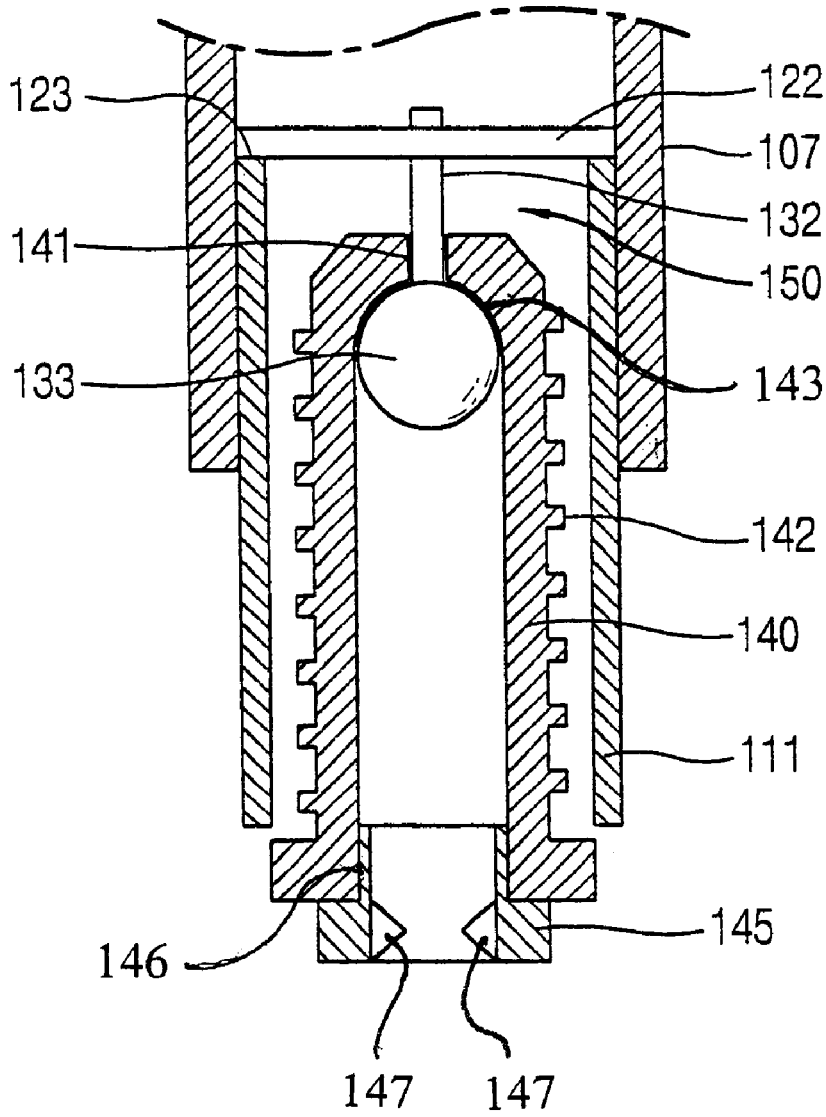
FIG. 3 illustrates a partially magnified view of an oil supply apparatus for FIG. 2.

FIG. 2 illustrates a cross-sectional view of a hermetic compressor according to an embodiment of the present invention and FIG. 3 illustrates a partially magnified view of an oil supply apparatus in FIG. 2.

Referring to FIG. 2 and FIG. 3, a hermetic compressor according to the present invention includes a hermetic casing 101 providing a hermetic space inside, a motor 103 installed inside the hermetic casing 101 so as to provide a driving power, a compression unit 130 carrying out a compression of a fluid by the driving power of the motor 103, and a oil supply apparatus 120 supplying an inside of the hermetic casing 101 with an oil so as to perform lubrication and cooling.

The motor 103 includes a stator 104 wound with a magnetization coil and a rotor 105 made of a permanent magnet, thereby generating a turning force by an electromagnetic reciprocal reaction between the stator 104 and rotor 105 when an electric power is applied to the stator 104.

The compression unit 130 includes a crankshaft 107 connected to the rotor 105 of the motor 103 to rotate and having an eccentric part 107*c* at an upper part, an eccentric pin 107*b* formed at the eccentric part 107*c* of the crankshaft 107, a connecting rod 108 connected to the eccentric pin 107*b* so as to transfer a turning force of the crankshaft 107, a piston 109 connected to the connecting rod 108 to reciprocate so as to carry out a compression of the fluid, a cylinder 106 having the piston 109 reciprocate inside and providing a compression room, and a valve assembly 110 installed at a front side of the cylinder 106 so as to open/close the compressed fluid.

The oil supply apparatus 120 includes a sleeve 111 coupled with a lower part of the crankshaft 107 so as to revolve together with the crankshaft 107, an oil flow path 112 formed inside the crankshaft 107, a sucking member 140 arranged in the sleeve 111 so as to maintain a uniform gap with an inner circumferential face of the sleeve 111 and sucking the oil by a reciprocal operation with the sleeve 111, and a support means 150 connected between the sleeve 111 and sucking member 140 so as to support the sucking member 140 so as to let the sucking member 140 slide, and an anti-rotating member 150 installed at a lower side of the sucking member 140 to generated a resistance force from a viscosity of the oil so as to prevent the sucking member 140 from rotating.

The sleeve 111 is cylindrical and connected to the lower part of the crankshaft 107 to revolve together. An end portion of the sleeve 111 is dipped in the oil filling the lower part of the hermetic casing 101.

The sucking member 140 is arranged at an inner circumference face of the sleeve 111 so as to maintain a uniform gap with the sleeve 111. A spiral oil flow path 142 is formed at an outer circumference face of the sucking member 140 so as to provide a suction force sucking the oil in an upper direction when the sleeve 111 revolves. And, a penetrating hole 141 is formed so as to penetrate an upper part of the sucking member 140 in a length direction.

The support means 150 includes a hanging member 122 connected to an upper side of the sleeve 111 in a radial direction, a connecting member 132 connected to a center of the hanging member 122 in a vertical direction, and a sliding portion formed between the connecting and sucking members 132 and 140 so as to support the sucking member 140 enabling to slide.

The sliding portion includes a hinge ball 133 built in one body with an end of the hanging member 122 and a spherical recess 143 at an entrance of the penetrating hole 141 of the sucking member 140 so that the hinge ball 133 slidably fits therein.

The hanging member 122 is formed to be a bar type so that both ends are connected to the upper end of the sleeve 111. The connecting member 132 is fixed to a center of the hanging member 122 so that the hinge ball 133 enables to rotate with the same of a revolving center of the sleeve 111. The hanging member 122 is fixed to the fixing recess 123 penetrating across the upper end of the sleeve 111.

The connecting member 132 penetrates an upper center of the sucking member 140 so as to be connected to the hanging member 122 vertically in an outer length direction of the sucking member 140, and is connected to the hinge ball 133 arranged inside the sucking member 140 in an inner length direction of the sucking member 140.

A contact face between the hinge ball 133 and the spherical recess 143 is preferably processed as smooth so that the hinge ball 133 enables to slide smoothly on the spherical recess 143.

The anti-rotating member 145 includes a fixed part 146 fitting in the penetrating hole 141 of the sucking member 140 so as to be fixed thereto and a plurality of blades 147 in an inner circumferential direction of the fixed part 146 so as to generate a resistance by the viscosity of the oil filling the lower part of the body. Preferably, the blades 147 formed in a direction opposite to the revolving direction of the sleeve 111 so as to increase the resistance force against the oil.

Operation of the above-constructed hermetic compressor according an embodiment of to the present invention is explained as follows.

Referring to FIG. 2 to FIG. 3, once the motor 103 is actuated, the crankshaft 107 connected to the motor 103 starts to revolve. And, the turning force of the crankshaft 107 is transferred to the connecting rod 108 through the eccentric pin 107*b*. The power transferred to the connecting rod 108 reciprocates the piston 109 inside the cylinder 106.

Therefore, the operation of the piston 109 compresses to blow the fluid flowing in the cylinder 106 externally.

And, the turning force of the crankshaft 107 is transferred to drive to the oil supply apparatus 120 so as to carry out the lubrication of the sliding and frictional parts inside the compressor.

Specifically, once the crankshaft 107 revolves by the rotation of the motor 103, the sleeve 111 coupled with the crankshaft 107 rotates as well so as to revolve connecting member 132 through the hanging member 122 fixed to the sleeve 111.

Moreover, the hinge ball 133 built integral with the lower part of the connecting member 132 rotates by the revolution of the connecting member 132.

In this case, the anti-rotating member 145 connected to the lower end of the sucking member 140 generates the resistance force against the oil so as to prohibit the sucking member 140 from revolving together with sleeve 111 to some extent.

And, the hinge ball 113 slides on the spherical recess 143 of the sucking member 140 due to the resistance force of the anti-rotating member 145 and the turning force of the sleeve 111.

Therefore, the sucking member 140 remains substantially stationary inside the sleeve 111, and the oil inside the hermetic casing 101 is sucked in along the spiral oil flow path 142 at the outer circumferential face of the sucking member 140 by the relative revolution of the sleeve 111 against the sucking member 140.

Thereafter, the oil sucked in through the sucking member 140 is carried to the upper part through the oil flow path 112 so as to be transferred to the sliding portion inside the hermetic casing 101, thereby carrying out the lubrication.

Moreover, as the sucking member 140 is supported by the support means 150 connected to the center of the hanging member so as to be located at an inner center of the sleeve 111, the gap between the outer circumferential face of the sucking member 140 and the inner circumferential face of the sleeve 111 can be maintained uniformly.

Figure 4:
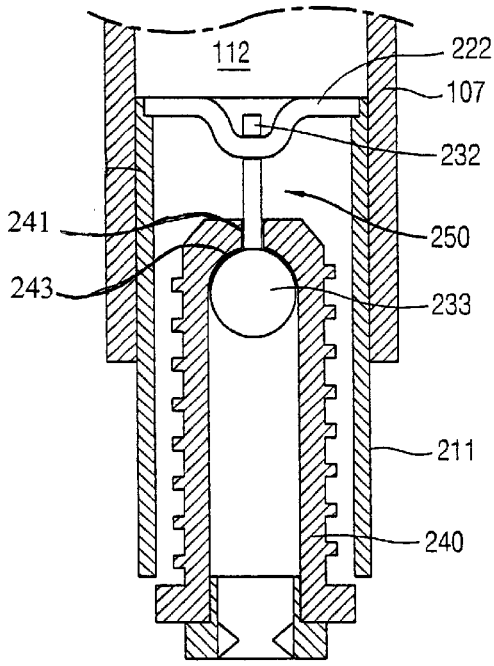
FIG. 4 illustrates a cross-sectional view of an oil supply apparatus for a hermetic compressor according to another embodiment of the present invention.
Figure 5:
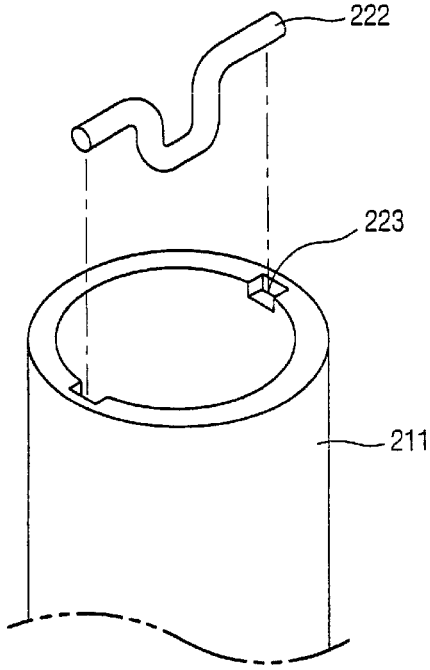
FIG. 5 illustrates a disassembled bird's-eye view of a hanging member and a sleeve in FIG. 4.

FIG. 4 illustrates a cross-sectional view of an oil supply apparatus for a hermetic compressor according to another embodiment of the present invention, and FIG. 5 illustrates a disassembled bird's-eye view of a hanging member and a sleeve in FIG. 4.

Referring to FIG. 4 and FIG. 5, a support means 250 of an oil supply apparatus for a hermetic compressor according to another embodiment of the present invention includes a hanging member 222 connected to an upper part of a sleeve 211 in a radial direction, a connecting member 232 connected to a center of the hanging member 222 in a vertical direction, and a sliding portion formed between the connecting member 232 and a sucking member 240 so as to enable the sucking member 240 to be supported to slide.

The sliding portion includes a hinge ball 233 built integral with an end of the hanging member 222 and a spherical recess 243 formed at a top face of a penetrating hole 241 of the sucking member 240 so as to enable the hinge ball 233 to slidably fit therein.

The hanging member 222 is formed to be a bar type so that both ends of the hanging member 222 are connected to an upper end of the sleeve 211. And, the connecting member 232 is connected to a center of the hanging member 222 so as to be hung in a vertical direction. Therefore, the hinge ball 233 is able to rotate concentric with the revolving center of the sleeve 211.

Both ends of the hanging member 222 are inserted into fixing ends 223 formed at the sleeve 211 so as to be fixed.

In order to couple the connecting member 232 with the center of the hanging member 222, the hanging member 222 extends from both ends in a horizontal direction to predetermined lengths so as to be bent downward in a middle portion. In the middle portion of the hanging member 222, a horizontal portion is formed to a predetermined length so as to be coupled with the connecting member 232.

Therefore, a hanging position of the connecting member 232 is restricted so as to make the connecting member 232 not move on the hanging member 222.

The connecting member 232 has a hook shape so as to be hung on the hanging member 222 in an outer length direction of the sucking member 240 by penetrating an upper center of the sucking member 240. And, the connecting member 232 is connected as one body to the hinge ball 223 installed inside the sucking member 240 in an inner length direction of the sucking member 240.

Explanation for the same components of the previous embodiment of the present invention is skipped in this description.

Operation and effect of the above-explained oil supply apparatus for the hermetic compressor according to another embodiment of the present invention are as follows.

The connecting member 232 is hung on the middle portion of the hanging member 222 so as to be connected to the hanging member 222, thereby simplifying its assembly process. The middle portion of the hanging member 222 is bent downward to restrict the hanging position of the connecting member 232 to be immovable, thereby enabling to maintain uniformly the gap between the sleeve 211 and sucking member 240.

Moreover, the fixing ends 223 are formed at the upper end of the sleeve 211 so as to make both ends of the hanging member 222 be fixed thereto, thereby enabling to fix the hanging member 222 to the sleeve 211 stably and safely.

Figure 6:
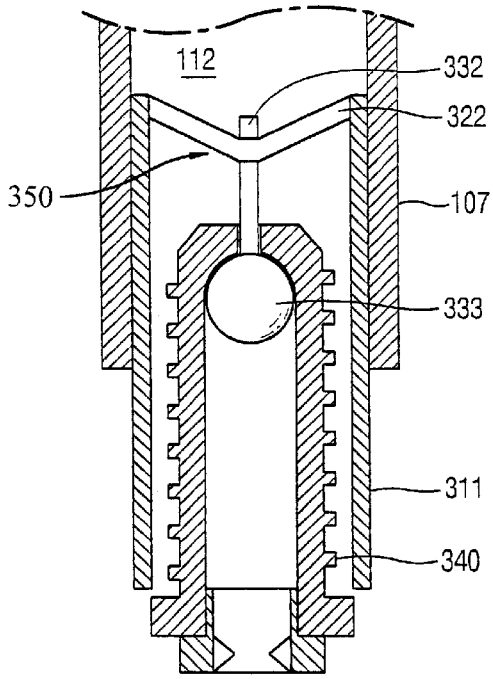
FIG. 6 illustrates a cross-sectional view of an oil supply apparatus for a hermetic compressor according to a further embodiment of the present invention.
Figure 7:
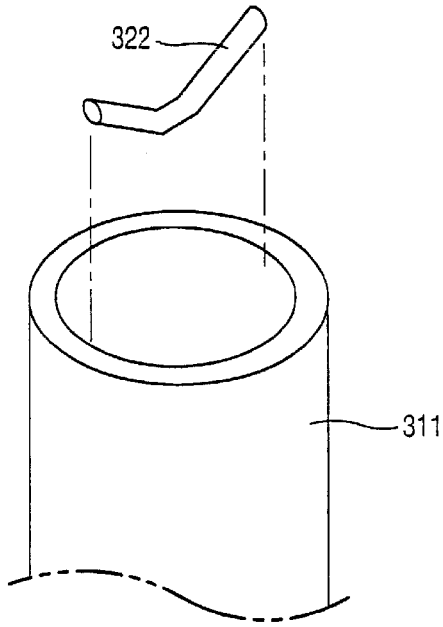
FIG. 7 illustrates a disassembled bird's-eye view of a hanging member and a sleeve in FIG. 6.

FIG. 6 illustrates a cross-sectional view of an oil supply apparatus for a hermetic compressor according to a further embodiment of the present invention and FIG. 7 illustrates a disassembled bird's-eye view of a hanging member and a sleeve in FIG. 6.

Referring to FIG. 6 and FIG. 7, a support means 350 of an oil supply apparatus for a hermetic compressor according to a further embodiment of the present invention includes a hanging member 322 connected to an upper part of a sleeve 311 in a radial direction, a hanging member 332 connected to a center of the connecting member 322 in a vertical direction, and a sliding portion formed between the hanging member 332 and a sucking member 340 so as to enable the sucking member 340 to be supported to slide.

The sliding portion includes a hinge ball 333 built integral with an end of the hanging member 322 and a spherical recess 343 formed at top face of a penetrating hole 341 of the sucking member 340 so as to enable the hinge ball 333 to slidably fit therein.

The hanging member 322 is formed to be a bar type so that both ends of the hanging member 322 are connected to an upper end of the sleeve 311. The connecting member 332 is connected to a center of the hanging member 322 so as to be hung in a vertical direction. Therefore, the hinge ball 333 is able to rotate concentric with the revolving center of the sleeve 311.

Both ends of the hanging member 322 are pushed into the sleeve 311 so as to be fixed with respect thereto. Namely, the hanging member 322 is installed in the sleeve 311 by being pushed into the sleeve 311 as elasticity of the hanging member 322 is slightly changed. In order to couple the connecting member 332 with the center of the hanging member 322, the hanging member 322 extends downward obliquely at a predetermined angle from both ends predetermined lengths so as to form a horizontal portion in the middle. The horizontal portion of the hanging member 322 is formed to a predetermined length so as to be coupled with the connecting member 332.

Therefore, a hanging position of the connecting member 332 is restricted so as to make the connecting member 332 immovable on the hanging member 322.

The connecting member 332 has a hook shape so as to be hung on the hanging member 322 in an outer length direction of the sucking member 340 by penetrating an upper center of the sucking member 340. The connecting member 332 is formed integral the hinge ball 323 which is installed inside the sucking member 340 in an inner length direction of the sucking member 340. Explanation for the same components of the previous embodiment of the resent invention is skipped in this description.

Operation and effect of the above-explained oil supply apparatus for the hermetic compressor according to another embodiment of the present invention are as follows.

The connecting member 332 is hung on the horizontal portion of the hanging member 322 so as to be connected to the hanging member 322, thereby simplifying its assembly process. Both side portions of the hanging member 322 are bent downward to immovably restrict the hanging position of the connecting member 332, thereby maintaining uniformly the gap between the sleeve 311 and sucking member 340.

Moreover, the hanging member 322 is installed directly in the sleeve 311 by being pushed therein, thereby enabling the hanging member 322 to be fixed to the sleeve 311 with ease.

As mentioned in detail in the above description of the hermetic compressor according to the present invention, the support shaft and hinge ball supporting the sucking member are connected to the center of the hanging member fixed to the sleeve, and the anti-rotating member is installed at the lower part of the sucking member so as to suppress the revolving tendency of the sucking member by generating the resistance against the oil.

Therefore, the present invention enables to maintain uniformly the gap between the inner circumference of the sleeve and the outer circumference of the sucking member, thereby improving a reliance of the oil supply.

Moreover, in the hermetic compressor according to the present invention, the connecting member is hung on the center of the hanging member so as to be connected to the hanging member, thereby simplifying its assembly process. And, the bent portion is formed at the central portion of the hanging member so as to hang the connecting member thereon to be immovable on the hanging member. Therefore, the present invention enables to maintain uniformly the gap between the inner circumference of the sleeve and the outer circumference of the sucking member, thereby improving a reliance of the oil supply.

Furthermore, in the hermetic compressor according to the present invention, the sleeve and sucking member construct a single assembly. Therefore, the present invention installs the single assembly at the crankshaft directly, thereby enabling to improve an assembling productivity of the compressor.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. An oil supply apparatus for a hermetic compressor, comprising:

a crankshaft coupled with a motor so as to revolve together therewith and having an oil flow path inside;

a sleeve connected to a lower part of the crankshaft so as to revolve therewith;

a sucking member arranged in the sleeve so that a uniform interval is maintained between an inner circumferential face of the sleeve and the sucking member so that a suction of an oil is carried out thereby; and a support device connected to the sleeve and configured to provide a slidable connection between the sleeve and sucking member so that the sucking member remains substantially in a stationary state within the sleeve.

2. The oil supply apparatus of claim 1, further comprising an anti-rotating member installed at a lower part of the sucking member so as to prevent the sucking member from rotating by generating a resistance force using a viscosity of the oil.

3. The oil supply apparatus of claim 2, wherein the anti-rotating member comprises:

a cylindrical fixed part inserted in a penetrating hole of the sucking member so as to be fixed thereto; and a plurality of blades formed in the cylindrical fixed part in an inner circumferential direction of the fixed part so as to generate a resistance against the oil filling a lower side of a body of the oil supply apparatus.

4. The oil supply apparatus of claim 1, wherein the sucking member is arranged inside the sleeve leaving a uniform interval therebetween, a spiral oil flow path is formed at an outer circumferential face of the sucking member so as to carry Out the suction of the oil, and a penetrating hole is formed in the sucking member in a lengthwise direction.

5. The oil supply apparatus of claim 1, wherein the support device comprises:

a hanging member connected to both upper sides of the sleeve in a radial direction;

a connecting member connected to a center of the hanging member and extending downward vertically; and a sliding portion formed between the connecting and sucking members so as to slidably support the sucking member.

6. The oil supply apparatus of claim 5, wherein the sliding portion comprises:

a hinge ball formed integral with an end of the connecting member; and a spherical recess formed adjacent a penetrating hole of the sucking member and configured to slidably receive the hinge ball therein.

7. The oil supply apparatus of claim 5, wherein the hanging member is a bar type member having a predetermined lengths, both ends of which are fixed to fixing recesses formed in an upper end of the sleeve.

8. The oil supply apparatus of claim 5, wherein the hanging member extends from a middle portion to both ends obliquely and is formed of an elastic material having a predetermined elasticity in a direction in which the ends of the hanging member extend.

9. The oil supply apparatus of claim 5, wherein ends of the hanging member fit into fixing recesses formed at an upper end of the sleeve and a middle portion of the hanging member is bent so as to precisely maintain a connecting position of the connecting member.

10. The oil supply apparatus of claim 1, wherein the sleeve is cylindrical so that an upper outer circumferential face of the sleeve is pushed against a lower side of the crankshaft.

11. The oil supply apparatus of claim 1, further comprising an anti-rotating member configured to prevent the sucking member from rotating by generating a resistance force using a viscosity of the oil.

12. The oil supply apparatus of claim 11, wherein the anti-rotating member comprises:

a cylindrical portion configured to be inserted into the sucking member and fixed thereto; and a plurality of blades extending from the cylindrical portion and configured to generate a resistance against the oil in a body of the oil supply apparatus.

13. A support device for an oil supply apparatus for a hermetic compressor, the oil supply apparatus having a crankshaft coupled with a motor so as to revolve together therewith and having an oil flow path inside, a sleeve connected to a lower part of the crankshaft so as to revolve together therewith, and a sucking member positioned within sleeve and configured to carry out suction of oil, the support device comprising:

a first portion configured to be connected to the sleeve of the oil supply apparatus; and a second portion slidably connected to the sucking member.

14. The support device of claim 13, wherein the first portion comprises a hanging member configured to be connected to an upper end of the sleeve, and the second portion comprises a connecting member connected to a center of the hanging member and extending downward vertically and a sliding portion formed at an end of the connecting member and slidably engaged with the sucking member.

15. The support device of claim 14, wherein ends of the hanging member are configured to mate with fixing recesses formed in an upper end of a sleeve of an oil supply apparatus and a middle portion of the hanging member is bent so as to precisely maintain a connecting position of the connecting member.

16. The support device of claim 14, wherein the hanging member obliquely extends from a middle portion to both ends.

17. The support device of claim 16, wherein the hanging member is formed of an elastic material having a predetermined elasticity.

18. The support device of claim 14, wherein the sliding portion comprises a hinge ball formed at an end of the connecting member and configured to engage with a spherical recess formed in the sucking member adjacent a penetrating hole of the sucking member.

19. The support device of claim 14, wherein the hanging member is in the shape of a bar having a predetermined length, both ends of which are configured to mate with fixing recesses formed in an upper end of the sleeve of the oil supply apparatus.

20. An oil supply apparatus for a hermetic compressor, comprising:

a crankshaft coupled with a motor so as to revolve together and having an oil flow path inside;

a sleeve connected to the crankshaft so as to revolve together therewith;

a sucking member positioned within the sleeve and configured to carry out suction of oil; and a support device comprising:

a hanging member connected to an upper end of the sleeve;

a connecting member connected to a center of the hanging member and extending downward vertically; and a sliding portion provided at an end of the connecting member and configured to provide a slidable connection between the connecting member and the sucking member.

21. The oil supply apparatus of claim 20, wherein the sliding portion comprises a hinge ball, wherein a spherical recess is provided adjacent to a penetrating hole of the sucking member, and wherein the hinge ball is configured to engage with the spherical recess.

22. The oil supply apparatus of claim 20, wherein the hanging member is in the shape of a bar having a predetermined length.

23. The oil supply apparatus of claim 20, wherein ends of the hanging member are configured to mate with fixing recesses formed in an upper end of the sleeve.

24. The oil supply apparatus of claim 20, wherein ends of the hanging member are configured to mate with fixing recesses provided in an upper end of the sleeve and a middle portion of the hanging member is bent so as to precisely maintain a connecting position of the connecting member.

25. The oil supply apparatus of claim 20, wherein the hanging member extends obliquely from a middle portion to both ends.

26. The oil supply apparatus of claim 25, wherein the hanging member is formed of an elastic material having a predetermined elasticity.

* * * * *